United States Patent [19]

Rogers

[11] 4,233,483

[45] Nov. 11, 1980

[54] APPARATUS FOR CONNECTING A SWITCH OPERATOR TO A SWITCH

[75] Inventor: Edward J. Rogers, Chicago, Ill.

[73] Assignee: S&C Electric Company, Chicago, Ill.

[21] Appl. No.: 26,849

[22] Filed: Apr. 4, 1979

[51] Int. Cl.[3] ..... H01H 25/00; H01H 1/50

[52] U.S. Cl. ..... 200/337; 200/250

[58] Field of Search ..... 200/153 L, 153 LB, 324, 200/337, 250, 337

[56] References Cited

U.S. PATENT DOCUMENTS

| | | | |
|---|---|---|---|
| 2,000,442 | 5/1935 | Healis | 200/250 X |
| 2,821,610 | 1/1958 | Thomson et al. | 200/337 |
| 3,041,431 | 6/1962 | Mills | 200/250 X |
| 3,422,238 | 5/1967 | Rys et al. | 200/337 X |

*Primary Examiner*—Steven M. Pollard
*Attorney, Agent, or Firm*—John D. Kaufmann

[57] ABSTRACT

A high-voltage switch is operated by a reciprocable link. The link is reciprocated by a rotatable driven member. A rotatable drive member is rotated by a switch operator. It is desired to lock the members together for conjoint rotation after each is placed in a predetermined position, for example, when the switch is closed and the operator is in the switch-closed position. The members are intended to be locked together by a fastener which passes through a hole in each member, but normal tolerances often lead to the holes being misaligned in an unpredictable member. Accordingly, an elongated slot is formed through one member. A hole is formed through the other member. The hole is so formed as to generally overlie and encompass the slot when the members are in their predetermined positions. A disk having an off-center aperture is put in the hole and rotated until the aperture overlies and is aligned with the slot. The fastener is then inserted through the aperture and the slot to pull the disk and the members together. The members are thereby locked together for conjoint rotation.

9 Claims, 6 Drawing Figures

40
56
66
68
54
52
58
62
64
60
32
D2
42
48
50
14
34
46
44
30
36
D3
60,66
D4
D5
38
28or22
4

APPARATUS FOR CONNECTING A SWITCH OPERATOR TO A SWITCH

BACKGROUND OF THE INVENTION

1. Field of the Invention

The present invention relates to apparatus for connecting a switch operator to a switch, and more specifically, to apparatus for connecting a high-speed, stored energy switch operator to a high-voltage switch, which apparatus permits both the operator and the switch to be in predetermined positions when they are connected even though mating parts thereof are not predictably positionally related.

2. Prior Art

Commonly assigned U.S. Patent Applications Ser. Nos. 911,122, 911,123 and 911,124, all filed May 30, 1978, commonly assigned U.S. Patent Application Ser. No. 922,326, filed July 6, 1978 and commonly assigned U.S. Pat. No. 3,980,977, all disclose various aspects of high-speed switch operators for high-voltage switches of the type generally described in commonly assigned U.S. Pat. Nos. 3,549,840 and 3,676,629 and in commonly assigned U.S. Patent Application Ser. No. 956,463, filed Oct. 30, 1978. The disclosed switch operators have output members which may reside in first or second positions depending upon whether the operator will subsequently attempt to open or close the switch. The positions of these output members must be rather well defined because high-voltage switches have rather precisely defined full-open and full-closed positions. Accordingly, mechanical connections between the switch operators and the switches cannot have any lost motion.

Further, at some point in the assembly of the switchgear, it is necessary to interconnect the separately manufactured switch operators and switches so that when the operator is in its switch-open position the switch is open, and, similarly, when the operator is in its switch-closed position, the switch is closed. Partial opening (or closing) of the switch when the operator is in the switch open (or switch-closed) position, or full opening (or closing) of the switch before the operator reaches its full switch-open (or switch-closed) position cannot be tolerated.

The present invention, therefore, contemplates that the switch and the operator are each first placed independently in complementary operating positions. The apparatus of the present invention then permits the interconnection of the switch and the switch operator when the operator and the switch are in such complementary positions. Should it happen that, because of manufacturing tolerances or other factors, the complementary positions do not exactly coincide, the apparatus of the present invention provides an adjustable feature which permits such interconnection without affecting the complementary positions, even though without the apparatus of the present invention such interconnections would prove difficult or impossible.

SUMMARY OF THE INVENTION

A switch operator according to the prior art includes an output member which rotates between a first position and a second position. When the output member is at its first position, a switch to which the output member is connectable is in a first position (open or closed). When the output member is in its second position the switch is similarly in a second position (closed or open). The output member rotates between its first and second positions on an axis. A driven member which forms a part of the switch may rotate about the same axis. To connect the switch operator to the switch it is necessary to interconnect the output member to the driven member. Such interconnection is desirably effected when the switch is fully in one of its positions and the switch operator is fully in its complementary position. Manufacturing tolerances and other factors may prevent the output member and the driven member from being easily interconnected when the switch and the switch operator are in the complementary positions.

Accordingly, the driven member has formed therein an elongated slot. The output member has formed therein an enlarged hole which generally, but not predictably precisely, overlies the slot when the members are in the complementary positions. A disk is insertable into the hole. Formed through the disk is an eccentric aperture. After the switch operator and the switch are put in the complementary positions, the hole through the driven member assumes an unpredictable and somewhat randomly varying position relative to the slot. The disk is placed into the hole and is rotated until the aperture overlies and aligns with the slot. A shouldered bolt is then inserted through the aperture and the slot and is drawn down until the disk is forced into the hole and the members are connected together. The rotation of the disk to overlie and align the aperture and the slot prior to the attachment with the shouldered bolt permits the switch operator and the switch to be made to normal manufacturing tolerances, while also permitting the members to be connected together as desired. After the shouldered bolt is fully drawn down, the switch operator may be operated normally. When the output member rotates the axis, the connection provided by the shouldered bolt and the disk effects conjoint rotation about the axis of the members to operate the switch.

DETAILED DESCRIPTION

Figure 1:
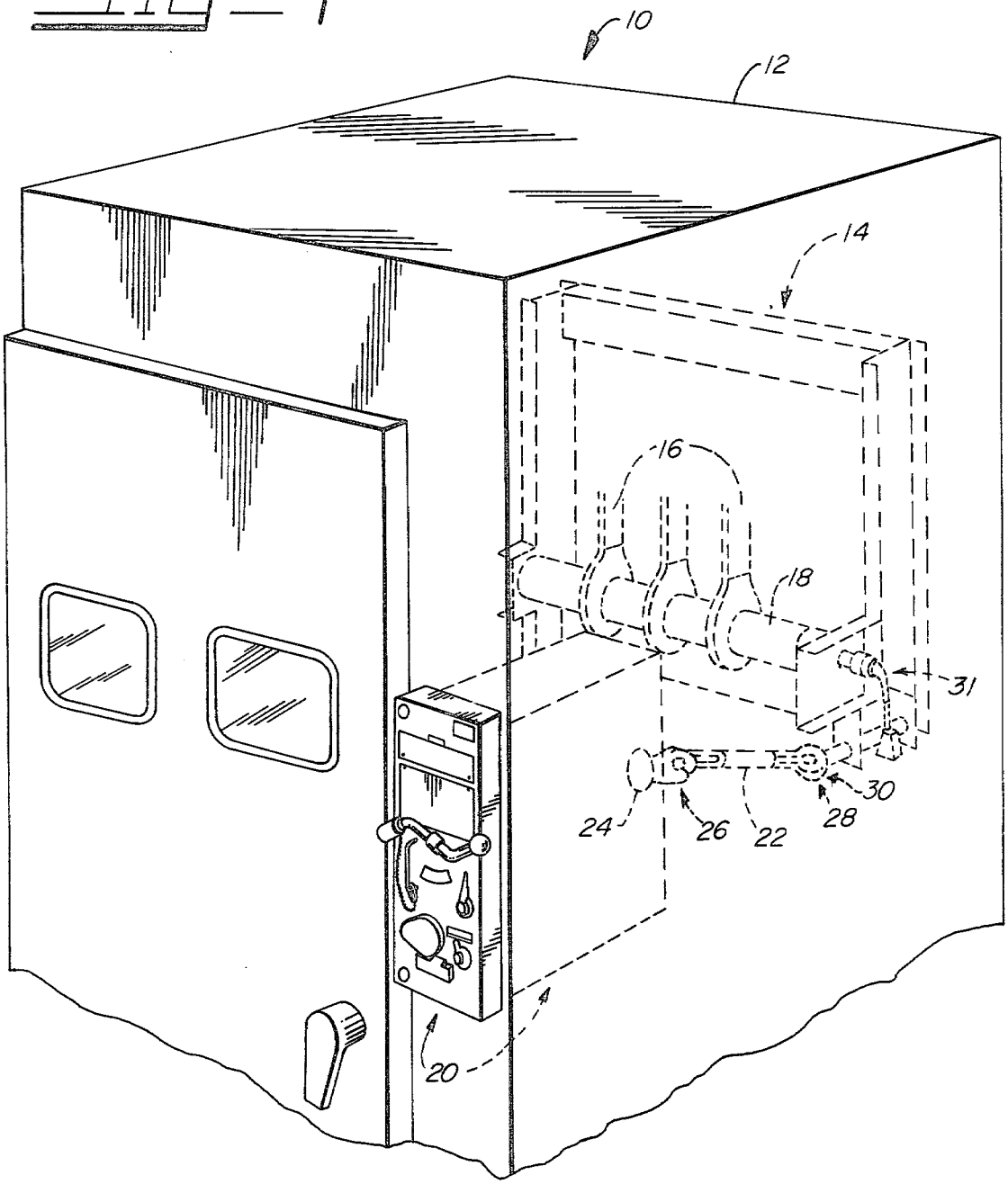
FIG. 1 is a perspective view of high-voltage switchgear, including a switch and a switch operator which are connected together by the apparatus of the present invention.

Referring first to FIG. 1, there is shown high-voltage switchgear 10. The switchgear 10 includes a metal enclosure 12 which contains a high-voltage switch 14. The high-voltage switch 14 may be of the type which includes switch blades 16 which are selectively rotatable into and out of engagement with stationary contacts (not shown) by rotation of an insulative strut 18. The strut 18 is rotated by the operation of a switch operator 20 within the enclosure 12. The switch operator 20 operates the switch 14 by an appropriate drive shaft 22 which is rotatably driven by an output hub 24 of the switch operator 20. Details of the switch operator 20 and of the switch 14 are more completely described in the aforementioned commonly assigned U.S. Patents and Patent Applications. It may be desirable that the switch operator 20 be at least partially removable from the enclosure 12 for maintenance and repair purposes. This desirable feature of the operator 20, in addition to the fact that the various parts of the switfh 14 and of the operator 20 are made to normal engineering tolerances, at times presents difficulties in conveniently interconnecting the switch operator 20 and the switch 14. With a view to rendering convenient this interconnection, the present invention is provided.

As shown in FIG. 1 the drive shaft 22 may slope from the operator 20 downwardly toward the switch 14. To this end, universal joints, generally indicated at 26 and 28, may be provided. The drive shaft 22 may also slope upwardly from the operator 20 to the switch 14, in which case the universal joints 26 and 28 may also be used. It is not necessary that the drive shaft 22 slope at all; it may be oriented horizontally between the switch operator 20 and the switch 14 in which case the universal joints 26 and 28 may not be required.

According to the present invention apparatus 30 is provided which permits the connection of the drive shaft 22 to the switch 14 regardless of manufacturing tolerances or the fact that the operator 20 is removable from the enclosure 12. The apparatus 30 is only generally indicated in FIG. 1 and is depicted as being near or at the universal coupling 28. If the universal joint 28 is not used, the coupling 30 is still preferably located nearer the switch 14 in the position shown. However, it should be appreciated that the apparatus 30, according to the present invention, may be located at the other end of the drive shaft 22 near the universal joint 26, or if such joint 26 is not used, nearer the operator 20.

Figures 2, 3A, 3B, 3C, 4:
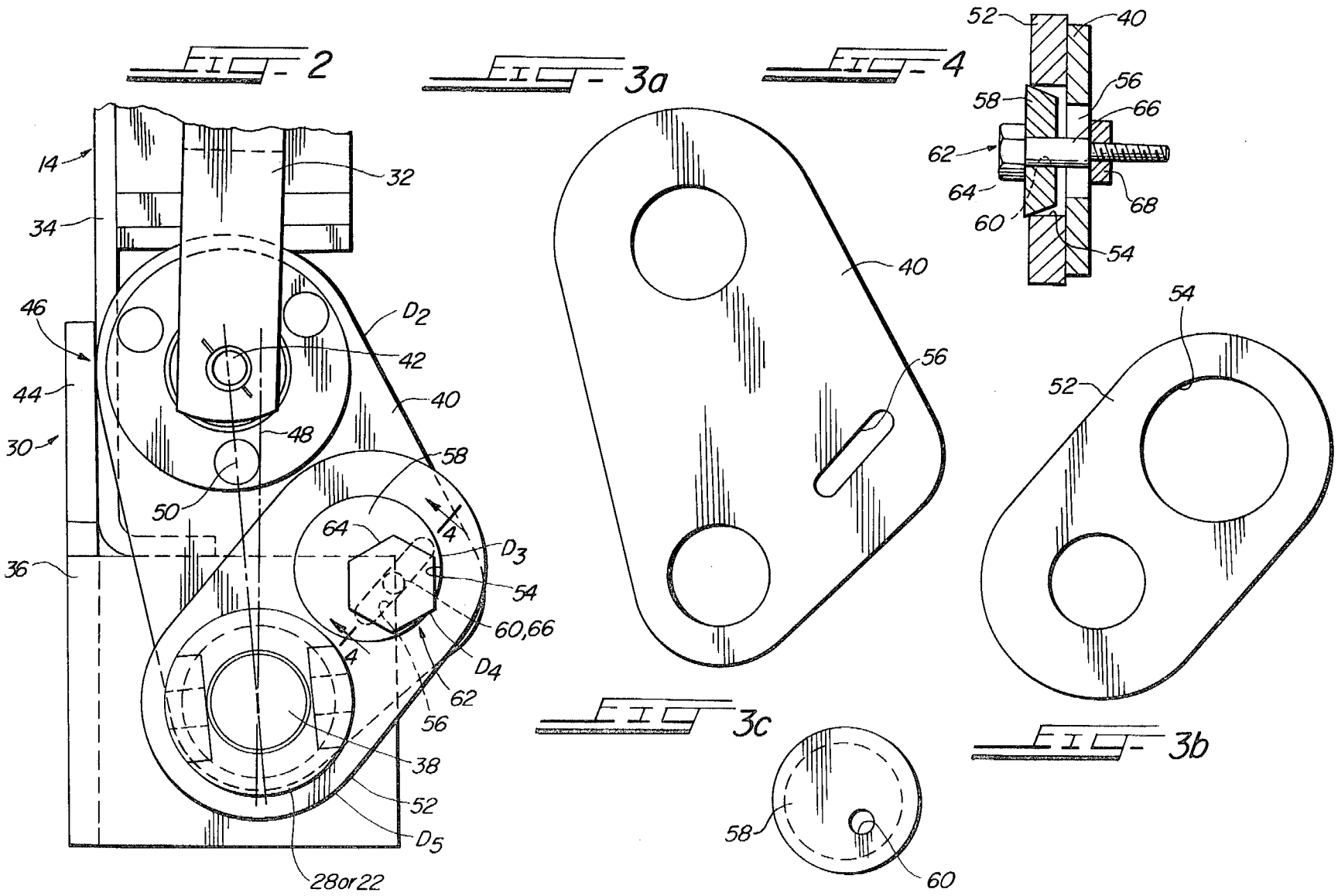
FIG. 2 is a front elevational view of apparatus according to the present invention for connecting together the switch operator and the switch of FIG. 1.
FIGS. 3*a*, 3*b*, and 3*c* depict the various parts of the apparatus of FIG. 2.
FIG. 4 is a partially sectioned view taken along line 4—4 of FIG. 2.

Turning now to FIG. 2, there is shown in detail apparatus 30 according to the present invention.

In FIG. 2, only a portion of the switch 14 is shown and none of the switch operator 20 is shown. The portion of the switch 14 depicted includes a switch driving member 32 which is reciprocable upwardly and downwardly. In the position of the switch member 32 depicted in FIG. 2, the switch 14 is in the closed position. To open the switch 14, the switch driving member 32 is reciprocated downwardly from the position shown.

Attached to a structural member 34 of the switch 14 is a support member 36. Rotatably mounted to the support member 36 is a pin 38. Mounted on the pin 38 is a driven lever 40. The driven lever 40 is rotatable on the pin 38 in the plane of FIG. 2. The driven lever 40 is typically connected to the switch driving member 32 by a pin 42 or the like. In FIG. 2, the switch driving member 32 is furcated and the pin 42 passes through both furcations as well as through an appropriate bearing in the driven lever 40. Clockwise rotation of the driven lever 40 pulls the switch driving member 32 downwardly to open the switch 14 and counterclockwise rotation of the driven lever 40 moves the switch driving member 32 upwardly to close the switch 14.

A portion of the support member 36 is formed into a stop 44. The position of the stop 44 and the configuration of the driven lever 40 are such that the driven lever 40 is rotated fully counterclockwise to close the switch 14 before a portion thereof abuts the stop 44 as indicated at 46. An imaginary, vertical line 48 connects the center of rotation of the driven lever 40 (the center of the pin 38) and the point (not shown) at which the switch driving member 32 applies force to the switch 14 for operation thereof. When the driven lever 40 abuts the stop 44, an imaginary line 50 connecting the center of the pin 38 to the center of the pin 42 is slightly left of the line 48. Thus, in the fully closed position of the switch 14, the driven member 40 and the switch driving member 32 are in an overtoggle or overcenter toggle position, preferably about 5 degrees away from the line 48. This overtoggle position maintains the switch 14 in its fully closed position, assures that good electrical contact is made between the switch blades 16 and the stationary contacts (not shown) of the switch 14, and prevents opening of the switch 14 absent operation of the operator 20.

The driven lever 40 is driven by an output lever 52. The output lever 52 is journalled for rotation about the pin 38. As indicated by the reference numerals 28 and 22, the lever 52 is formed integrally with, or is otherwise attached to, either the universal joint 28, if such is used, or the drive shaft 22. Thus, rotation of the drive shaft 22 rotates the drive lever 52.

The position of the drive lever 52 shown in FIG. 2 is that assumed when the switch operator 20 is in its switch-closed position. It is necessary to connect the drive lever 52 to the driven lever 40 so that operation of the switch operator 20 operates the switch 14.

To this end, formed in the drive lever 52 opposite the pin 38 is a hole 54. Formed in the driven lever 40 is an elongated slot 56. When the switch 14 is in its fully closed position and the operator 20 is in the switch-closed position, the hole 54 generally overlies and encompasses the slot 56. Because of manufacturing tolerances and of the removability of the operator 20, the exact relative positions of the hole 54 and the slot 56 cannot be accurately predicted. Nevertheless, the size of the hole 54 and the position and length of the slot 56 may be selected so as to ensure that the hole 54 overlies and encompasses the slot 56.

Inserted into the hole 54 is a tapered disk 58. The tapered disk contains an eccentric aperture 60, that is, an aperture 60 formed through the disk 58 away from the center thereof. A connecting member, such as a shouldered bolt 62, only the head 64 is of which is visible in FIG. 2 has a shank 66 which passes through both the aperture 60 and the slot 56. The bolt 62 may be pulled down by a nut 68 (not visible in FIG. 2; see FIG. 4) to pull the tapered disk 58 into the hole 54 and to lock the drive lever 40 to the lever 52. Thus, rotation the drive lever 52 by the operating mechanism 20 rotates the driven lever 40 to operate the switch 14.

Assuming that the manufacture of the switch 14 and of the switch operator 20 have been completed, and that both have been placed within the enclosure 12, it is now necessary to couple the operator 20 to the switch 14. In the past, a simple hole was formed through the drive lever 52 and another hole was formed to the driven lever 40. It was intended that a bolt or the like be placed through both holes to lock the levers 40 and 52 together so that rotation of the drive lever 52 rotated the driven lever 40. However, because the switch 14 must be in its fully closed position and the operator 20 must be fully in its switch-closed position, and because of normal manufacturing tolerances, it was often difficult if not impossible to align these holes for insertion of the bolt therethrough without moving either the switch 14 or the operator 20 out of such full positions. In accordance with the present invention, the switch 14 is put in its fully closed position by ensuring that the driven lever 40 abuts the stop 44. The switch operator 20 is put in its full switch-closed position. The hole 54 is made sufficiently large so as to generally overlie and encompass the slot 56 as shown in FIG. 2. The tapered disk 58 is then placed loosely into the hole 54 and is rotated in either direction until the eccentric aperture 60 overlies and is aligned with some portion of the slot 56. At this point, the shouldered bolt 62 is placed through the aperture 60 and the slot 56, and the nut 68 is run thereon to clamp the levers 40 and 52 together.

The use of the tapered disk 58 eliminates the requirement that the levers 40 and 52 and the numerous other elements of the switch 14 and the operator 20 be made to exacting manufacturing to tolerances so that holes therethrough exactly line up when the switch 14 and the switch operator 20 are fully in predetermined positions. The ability to rotate the tapered disk 58 until its aperture 60 and the slot 56 are aligned, eliminates the need for extremely close manufacturing tolerances, and permits the switch 14 and the operator 20 to be interconnected in the desired manner.

In FIG. 3, the various elements of the apparatus 30 according to the present invention are shown in their disassembled state. In FIG. 4, the manner in which the nut 68 holds the shouldered bolt 62 to lock the levers 40 and 52 together is depicted.

The apparatus 30 of the present invention may also be used to couple together two reciprocating members, or, one reciprocating and one rotating member, as should be obvious.

What is claimed is:

1. Apparatus for locking a first rotatable member to a second rotatable member so that the members rotate coaxially together about a common axis, the members being locked together while they are in independent, predetermined angular positions about the axis whereat their relative angular orientation is unpredictable and random; the apparatus comprising:

an elongated slot formed through the second member;

a hole formed through the first member so as to generally overlie and encompass the slot when the members are in their predetermined positions;

a tapered disk having an off-center aperture therethrough, the disk being insertable into the hole and rotatable until the aperture is visually observed to overlie and be aligned with the slot; and connecting means insertable through the aligned aperture and slot for pulling the first member and the disk toward the second member to lock the members together so that they are coaxially rotatable together and to jam the disk into the hole to prevent rotation therein.

2. The apparatus of claim 1, wherein the connecting means comprises a shouldered bolt, the main body of which may reside in the aperture and the slot so that its head bears on one of the members, and a nut threadable on to the bolt to bear on the other member.

3. The apparatus of claim 2, wherein the first member is a drive member and the second member is a driven member.

4. The apparatus of claim 3 for use in high-voltage switchgear, wherein the first member is connectable to a switch operator and the second member is connectable to a switch.

5. The apparatus of claim 1, wherein the second member is rotatably connectable to a link which reciprocates as the second member rotates, and the second member and the link form a toggle, and which further comprises a stop, the second member abutting the stop in its predetermined angular position so that the toggle is over center and so that the hole generally overlies and encompases, but has an unpredictable orientation with respect to, the slot.

6. The apparatus of claim 5, for use in high-voltage switchgear wherein the link is connectable to a high-voltage switch which is operated by reciprocation of the link, and the first member is connectable to a switch operator for rotation thereby.

7. Apparatus for locking together for conjoint coaxial rotation about a common axis a pair of rotatable members, it being necessary to lock the members together after they are first moved to predetermined, angular positions about the axis whereat their exact relative angular orientation is randomly unpredictable; the apparatus comprising:

an elongated slot through one member;

a hole through the other member, the hole having a size and location so as to generally overlie and encompass the slot when the members are in the predetermined positions;

a tapered disk having an off-center aperture, the disk being insertable into the hole and rotatable therein until the aperture is visually observed to overlie and be aligned with the slot; and a connecting means insertable through the aligned aperture and slot to lock the members together and to jam the disk into the hole to prevent rotation therein.

8. Apparatus for locking a first movable member to a second movable member so that the members move together, the members being locked together while they are in independent, predetermined positions whereat their relative orientation is unpredictable and random; the apparatus comprising:

a slot formed through the second member;

a hold formed through the first member so as to generally overlie and encompass the slot when the members are in their predetermined positions;

a tapered disk having an off-center aperture therethrough, the disk being insertable into the hole and rotatable until the aperture is visually observed to overlie and be aligned with the slot; and connecting means insertable through the aligned aperture and slot for pulling the first member and the disk toward the second member to lock the members together so that they move together and to jam the disk into the hold to prevent rotation therein.

9. Apparatus for locking a first member rotated by a switch operator to a second member which rotates to operate a switch so that the members rotate coaxially together, the members being locked together while they, the operator, and the switch are in independent, predetermined positions whereat the relative angular orientation of the members about a common axis is unpredictable and random; the apparatus comprising:

an elongated slot formed through the second member;

a hole formed through the first member so as to generally overlie and encompass the slot when the members are in their predetermined positions;

a tapered disk having an off-center aperture therethrough, the disk being insertable into the hole and rotatable until the aperture is visually observed to overlie and be aligned with the slot; and connecting means insertable through the aligned aperture and slot for pulling the first member and the disk toward the second member to lock the members together so that they are coaxially rotatable together and to jam the disk into the hole to prevent rotation therein.

* * * * *